US011363882B2

(12) United States Patent
Zhang

(10) Patent No.: US 11,363,882 B2
(45) Date of Patent: Jun. 21, 2022

(54) READING BOOK STAND

(71) Applicant: Xiaochuan Zhang, Hebei (CN)

(72) Inventor: Xiaochuan Zhang, Hebei (CN)

( * ) Notice: Subject to any disclaimer, the term of this patent is extended or adjusted under 35 U.S.C. 154(b) by 0 days.

(21) Appl. No.: 16/477,883

(22) PCT Filed: Jan. 31, 2018

(86) PCT No.: PCT/CN2018/000059

§ 371 (c)(1),
(2) Date: Jul. 13, 2019

(87) PCT Pub. No.: WO2018/153166

PCT Pub. Date: Aug. 30, 2018

(65) Prior Publication Data

US 2019/0365092 A1 Dec. 5, 2019

(30) Foreign Application Priority Data

Feb. 21, 2017 (CN) ..... 201710092362.1
Feb. 21, 2017 (CN) ..... 201720154336.2

(51) Int. Cl.
*A47B 23/04* (2006.01)

(52) U.S. Cl.
CPC ..... *A47B 23/043* (2013.01)

(58) Field of Classification Search
CPC ..... A47B 23/043; A47B 23/04; A47B 23/042; A47B 23/044
See application file for complete search history.

(56) References Cited

U.S. PATENT DOCUMENTS 2,219,091 A * 10/1940 Henderson ..... A47B 23/043 248/452
2,478,849 A * 8/1949 Thompson, Sr. .... A47B 23/043 248/444
4,460,146 A * 7/1984 Raggiotti ..... A47G 1/24 248/456
4,466,593 A * 8/1984 Odenath ..... A47B 23/04 248/455
4,518,140 A * 5/1985 Ferranto ..... A47B 97/08 108/32
5,451,025 A * 9/1995 Hames ..... A47B 23/043 248/452
5,746,410 A * 5/1998 Hung ..... B41J 29/15 248/441.1
7,334,768 B1 * 2/2008 Lum ..... A47B 23/04 248/444

(Continued)

FOREIGN PATENT DOCUMENTS

CN 103182881 A 7/2013

*Primary Examiner* — Anita M King
(74) *Attorney, Agent, or Firm* — MagStone Law, LLP; Enshan Hong

(57) ABSTRACT

A reading book stand mainly comprises a base plate (1) and a support plate (2) and a clamp (3). An intersecting line divides a length (L) of the base plate into two parts ($L_1$) and ($L_2$). A reading angle (A) is not less than 90 degrees. This is applicable for a book in which the vertical forward direction of text on pages having the text of the main text part is nearly perpendicular to the spine of the book and points toward the fore edge of the book that is nearly parallel to the spine of the book.

4 Claims, 10 Drawing Sheets

(56) References Cited

U.S. PATENT DOCUMENTS

| | | | | |
|---|---|---|---|---|
| 8,770,536 | B2 * | 7/2014 | Hu | G01R 31/2808<br>248/447 |
| 2003/0029985 | A1 * | 2/2003 | Zeller | B42F 9/004<br>248/461 |

* cited by examiner

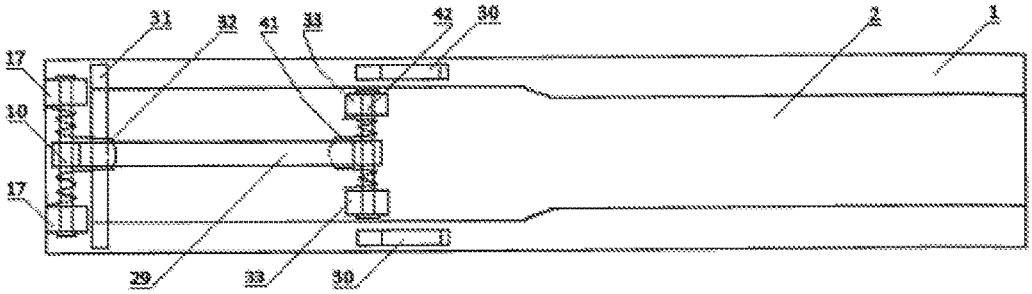
Fig. 8.1
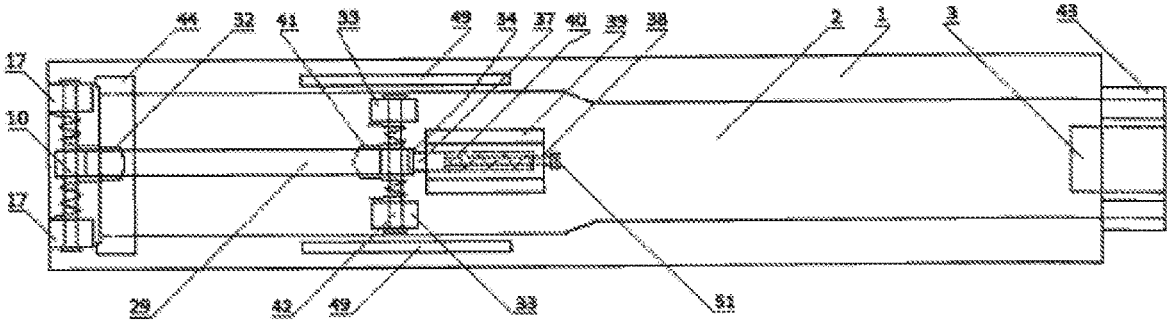
Fig. 8.2

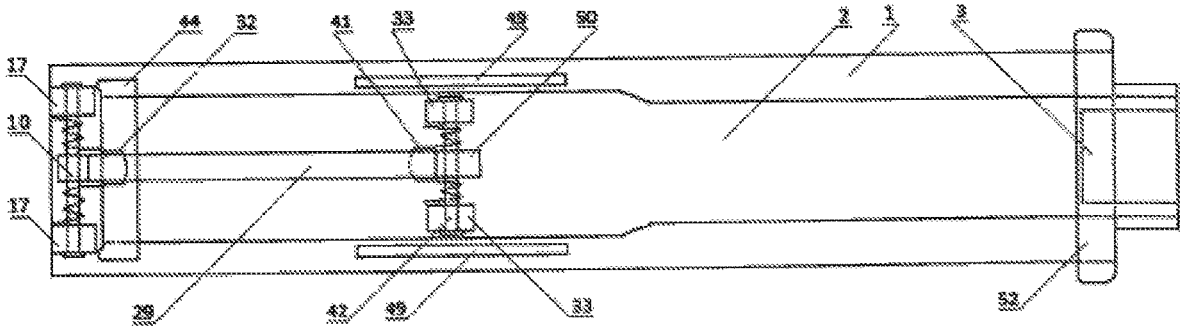
Fig. 9.1

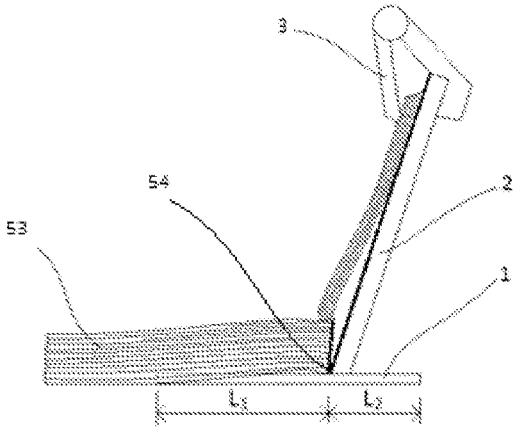
Fig. 10
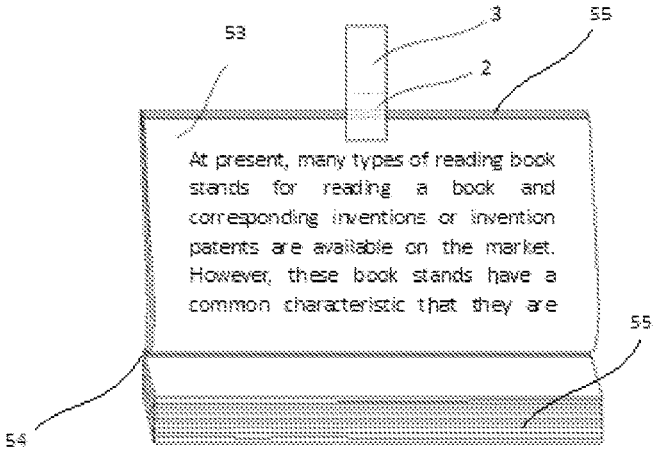
Fig. 10.1

READING BOOK STAND

This is a U.S. national stage of application No. PCT/CN2018/000059, filed on Jan. 31, 2018. Priority is claimed on the following applications: China Application Nos.: 201720154336.2 filed Feb. 21, 2017 and 201710092362.1 filed Feb. 21, 2017, the content of which is incorporated here by reference

TECHNICAL FIELD

The present disclosure relates to a reading book stand.

BACKGROUND

At present, many types of reading book stands for reading a book and corresponding inventions or invention patents are available on the market. However, these book stands have a common characteristic that they are applicable to traditional books. The traditional book usually includes elements such as a front cover, a back cover, a book spine, a page and a page number and is characterized in that vertical directions of texts on two surfaces of each page of a main text part are both approximately parallel to the book spine. For a book of horizontal typesetting, a row of each page of a main text part is approximately perpendicular to a book spine. For a book of vertical typesetting, a row of text of each page is approximately parallel to a book spine. The present disclosure is applicable to a new type or a special type of reading materials such as books, practice books and picture books, in which a vertical direction of a text on a page with a text (the text referred to herein includes different languages of the world and different graphs and pictures and so on) on a main text part is approximately perpendicular to a book spine and a vertical forward direction of a text on the main text part of each page points to a fore edge of book approximately parallel to the book spine, where a direction in which the text points from a lower edge to an upper edge in a vertical direction is set to a forward direction of text. For example, the new type of book (ZL 201110455454.4) may achieve a good use effect in combination with the reading hook stand of the present disclosure.

SUMMARY

The subject of the present disclosure is to provide a reading book stand for a new type of or a special type of reading materials such as books, practice books, picture books, for example, a new type book (ZL 201110455454.4), in which a vertical forward direction of a text on a page with a text on a main text part is approximately perpendicular to a book spine and the vertical forward direction of the text on the main text part of each page points to a fore edge of book approximately parallel to the book spine, so that a reader can read these books very easily like watching a laptop computer.

The technical solution of the present disclosure is described below.

The new type book (ZL 201110455454.4) can achieve a reading state with grip of a human hand although the new type book in the reading state is similar to a laptop computer in a use state. It is only required to fix the book with a rigid support and fixture if the grip of a human hand is removed. An outer edge of the rigid support, i.e. the reading book stand of the present disclosure should be matched with an optimal reading opening state of the new type book. However, compared with a reading book stand used by traditional books, the reading book stand may have a width as narrow as only about 1/10 of that of a traditional reading book stand. For example, a width of the traditional reading book stand is generally between 200 mm and 300 mm while the reading book stand of the present disclosure may be narrowed to about 20 mm-30 mm, and even less than 1/10 of a length of a book spine used for reading a book. To ensure the reading book stand with such a narrow width has a good reading stability, it is required to utilize the rigidity and gravity of the book itself so that the book itself becomes a part of a stable mechanical structure of the reading book stand in normal use. However, unlike watching a laptop computer, reading a book with the reading book stand is a process in which pages are turned continuously and the gravity of book continuously changes. Furthermore, in this process, a pulling force applied to the reading book stand by the book through the fixture also changes continuously. These factors are problems to be solved in the present disclosure. The optimal reading opening state of the reading book stand of the present disclosure should be consistent with the optimal reading opening state of the laptop computer.

As shown in FIG, 1, the reading book stand of the present disclosure mainly includes a base plate, a support plate, and a clamp that is located at an end of the support plate and used for clamping a fore edge of a read book. A refers to a reading angle no less than 90 degrees. Test statistics show that a habitual angle for opening a laptop computer is between 100-110 degrees. However, a reading page of a paper book usually is bent during reading. The reading angle of the reading book stand of the present disclosure is set to about 100-135 degrees. The reading book stand of the present disclosure has two cases that the reading angle A is adjustable and fixedly unadjustable. The support plate and the base plate may be fixedly combined and may also be shaft-connected and plug-connected.

Those with the shaft connection and the plug connection are portable reading book stands. To facilitate storing and carrying, the support plate and the base plate may also be made into a foldable type. For a reading book stand with a reading angle adjustable (as shown in FIG. 6), a reader may perform arbitrary adjustment according to his preference. If the support plate and the base plate are made with a metal or a nonmetal material having a particular thickness, length, straightness, equal width and a good strength-toughness match, the support plate and the base plate are combined together at a particular angle so that there will be a combination line or an intersecting line between the support plate or a plane overlapping with a surface that is on the support plate and faces the reader and an upper surface of the base plate. The intersecting line is located at a proper position between both ends of the base plate and divides the base plate into two parts $L_1$ and $L_2$. The $L_1$ and the $L_2$ should have a sufficient length and a proper width. Bottom surfaces of The $L_1$ and the $L_2$ (a placing surface in contact with a desk surface or another plane (plate)) should be located in a same plane and the upper surfaces of the $L_1$ and the $L_2$ are not required to be in a same plane. A thickness of the $L_1$ is limited generally to no less than 3 mm (except for a case that a box is used as the base plate) and a thickness of $L_1$ is relatively non-limited. Generally, the $L_1$ and the $L_2$ are made with a same plate. If the support plate rotates with the intersecting line as a rotation axis, the support plate may be theoretically rotated to a position where the support plate is parallel to and overlapped with the base plate. At this time, a center line of the support plate along a length direction is also parallel to and overlapped with a center line of an adjacent surface of the base plate. If the support plate adopts a hollow or a solid round rod part (that is, the support plate is replaced with the round rod part), the round rod part may be rotated to be in contact with the base plate according to the assumed support plate rotation positioning method of the present disclosure, and a contact surface may be a straight line. The straight line should be parallel to and overlapped with the center line of a surface along a length direction of the base plate. It is noted that in an actual fabrication, the base plate is required to be straight and the support plate (rod) is not required to be necessarily straight. The straightness of the support plate (rod) is an assumption to meet the locating needs. An actual requirement for the support plate (rod) is that the support plate should pass across a plane of a straight line where a clamping edge of the clamp is located and straight line where the theoretical intersecting line is located, and there should not be excessive and overlarge protrusions exceeding the plane and affecting use between the two straight lines. However, for the foldable reading book stand in the present disclosure, any protrusion affecting the folding of the book stand is not allowed and excessive and overlarge recesses may be allowed as long as these recesses do not affect use. Therefore, the support plate (rod) may be made into different flower-style patterns but the entire center of gravity of the support plate (including the clamp or the clamp and all devices mounted on the support plate (rod)) shall fall on the center line of the base plate along the length direction accurately with a smaller error. In a normal use state, the reading book stand in the present disclosure is placed on a desk surface or on another plane (plate), the center lines of the support plate and the base plate may be approximately perpendicular to a back spine of a book respectively, and a middle part of the back spine is placed on the intersecting line. The book is opened and divided into two parts. One part where a read page is located is leaned against the support plate and a forward direction of a text of the read page points toward the clamp, where a direction in which the text points from a lower edge to an upper edge in a vertical direction is set to a vertical forward direction. A margin that is nipped to be straight as possible and is above a printing center at a middle part of the fore edge of the pages of the part where the read page is located is clamped with the clamp so that the book will not leave the base plate when lifted. Due to a clamping force, a large friction force is generated between the book and the support plate, so that the clamped pages will not fall. The other part naturally falls on the base plate and forms a vertical pressure with the book spine of the book for the base plate, so that the reading book stand will not be toppled leftward or rightward relative to the reader. The margin that is above the printing center at the fore edge and clamped by the clamp forms a relatively stable triangular or trapezoidal structure with the book spine of the book and thus the book itself becomes a part of the stable mechanical structure of the reading book stand. Different proper books can be read with the reading book stand of the present disclosure. During an entire reading process, a sum of torques applied to the reading book stand is sometimes positive and sometimes negative relative to the reader. The support plate divides the base plate into two parts which can withstand torsional torques from different directions by having sufficient lengths so that it can be prevented that a forward or a backward torsional topple relative to the reader with a lower edge of one end of both ends of the base plate as a rotation axis parallel to the intersecting line of the support plate and the base plate occurs to the reading book stand at different times during use.

The clamp is placed at an end of the support plate. The clamp and the support plate may be combined fixedly or may be moveable relative to each other or may be both moveable relative to each other and moveable away from each other. The relative movement of the clamp and the support plate is achieved by fixing the clamp on a sliding base matched with the support plate through a sliding groove (channel). The support plate serves as one clamping plate of the elastic clamp. Alternatively, the support plate is made into a pliable telescopic type while the clamp is fixed on the end of the support plate. The clamp and the support plate may be combined by directly using an ordinary spring clamp available from market rather than using the sliding base. In use, the clamp is assembled to the support plate, the support plate passes from the middle of two clamping plates of the clamp through a spring shaft, the support plate serves as the sliding channel of the clamp for adjusting a length of the clamping distance. In a case of no use, the spring clamp may be disassembled by pulling. The two clamping plates of the clamp may be of equal length so that both ends of the fore edge of the read page are prevented from tending to fall when a wider book is read and the reading angle A is large. Further, the two clamping plates of the clamp may also be of non-equal length. When a clamp with two clamping plates non-equal in length is adopted, the clamp needs to be specially customized so that a long clamping plate is placed at the back cover or the front cover of the book and a short clamping plate is placed at the read page of the book. A sliding stroke section of the clamp on the support plate and a contact region of a damping edge and the book and the support plate on the support plate may be made into pitted surfaces such as a pitted surface and a grooved surface to increase a sliding friction force.

The reading angle of the portable reading book stand may be fixed by an elastic snap or a magnetic attraction snap. The elastic snap is exactly tightened by use of the elasticity of material itself when the reading book stand is opened to a set position. A wedge braking ratchet mechanism may be adopted for the reading book stand with an adjustable reading angle A.

To allow the portable reading book stand to present a beautiful look, casing decoration may be added locally, for example, near a shaft base of the base plate, and components such as the clamp may also be made into a craftwork or an artistic work. The finished product shall also be packaged by a delicate box.

For the reading book stand of the present disclosure, modification may be performed for the structural sizes of a box for placing different living and ordinary study articles to allow the box to serve as the base plate of the reading book stand as long as the stand can be placed stably on the box in a case that books are placed on the upper surface of the box. For example, the length of the $L_1$ shall not be less than ⅔ of the length of $L_{smax}$ and the width of the L1 shall not be less than ½ of a length of a book spine of a book with maximum sizes set to be read. Costs will be reduced by improving the utilization rate of articles through integration of usages. The box may be opened by flipping a cover or by pull.

The material of the reading book stand may be metal or nonmetal material or a combination of nonmetal and metal materials, which should have a good strength-toughness match to ensure durability of the product. The finished product of a non-rust-resistant material should be subjected to a rust resistance treatment, for example, may be plated or coated for rust resistance while presenting a beautiful look.

The exterior sizes shall be minimized on the condition of meeting a use requirement, so as to save materials and reduce occupation space.

To allow a book to be stably placed on the $L_1$ of the base plate, the $L_1$ should be thin as possible, and generally shall be no greater than 3 mm and no less than 1 mm to ensure a use strength. The entire mechanical stability of the reading book stand of the present disclosure for reading a hardback book is better than that for reading a paperback book. The hardback book has a good rigidity because the front cover and the back cover of the book are made of cardboards. For the paperback book having less gravity due to smaller reading thickness, the paperback book has a poor rigidity when the clamp clamps less pages. Further, a part of the book spine of the paperback book and the paperback book falling on the base plate has insufficient pressure on the base plate, and therefore, the base plate of the reading book stand shall not be excessively narrow when used for reading a paperback book. Considering the reading book stand can still stand stably without the book, the width of the base plate is generally no less than 30 mm. The width of the support plate is usually no greater than the width of the base plate as long as the strengths of different components and the entire rigidity of the reading book stand permit and no plastic deformation occurs to the reading book stand in a case of bearing the weight of the book. The base plate and the support plate may be very narrow in width and especially the support plate may be narrowed to about 10 mm depending on specific requirements. In addition to a sheet material, the support plate may also adopt other forms of materials such as a hollow pipe, a round rod, a triangular rod and a polygonal rod and so on. The type of the clamp matched with the support plate for sliding may be flexibly determined according to the type of the support plate. It is recommended that the base plate adopts a metal sheet material having a good strength-roughness match and a thickness of 1-2 mm. In a case of use of a nonmetal material, the thickness of the base plate should be extended to no greater than 3 mm. It is recommended that the width of the base plate is between 30-50 mm. Correspondingly, the width (diameter) of the support plate (rod) shall be less than the width of the base plate and it is reasonable that the width of the support plate is about 10-20 mm. Considering factors such as material saving, beautiful appearance, practicability, durability, storage, transportation and ease to carry and so on according to the use requirements, different models of reading book stands may be fabricated to satisfy different requirements for exterior sizes and material strengths of the reading book stands.

It is noted that the support plate and the base plate of the reading book stand of the present disclosure may be very narrow, for example, narrowed to about 10-20 mm and of course may also be made very wide. "Very narrow" herein refers to that the base plate and the support plate may be narrowed to only about 1/10 of the width of a traditional reading book stand, which is one significant feature of the present disclosure.

The beneficial effects of the present disclosure are as follows: when reading a new type book (ZL 201110455454.4), a reader may free his two hands to do reading and other things at the same time, for example, the reader may make notes and craftwork and so on, thereby optimizing the benefits of the new type book. A traditional reading book stand needs to control the left and right parts of an opened book with two clamps at the same time and the reading book stand of the present disclosure only needs to control a part of the opened book with one clamp and also its width may be very narrow, for example, may be narrowed to about 1/10 of the traditional reading book stand. Therefore, compared with the traditional reading book stand, the reading book stand of the present disclosure has the advantages of simple structure, small volume, light weight, low costs, ease of operation, good stability and ease to carry and so on, so that such new type book, for example, the book (ZL 201110455454.4), has an applicable reading book stand, thereby perfecting its reading method system and releasing potential beneficial functions of such type book.

BRIEF DESCRIPTION OF THE DRAWINGS

FIG. 8.1 is a top view of a folding state after a spring is added and a clamp 3 is removed based on FIG. 8.

FIG. 8.2 is a schematic diagram illustrating a structure of an example of a foldable portable reading book stand with a connecting rod hinge mechanism and an adjustable reading angle A, which is also a top view of a folding state after a spring mechanism and a wedge braking ratchet mechanism are added, an elastic snap eye 30 of a braking snap is removed and a lever snap 31 is replaced by an anchor 44 at the same time.

FIG. 9.1 is a top view of a folding state of FIG. 9.

FIG. 10 shows a book on a portable book stand in accordance with an embodiment of the present application.

FIG. 10.1 shows a book being opened on a book stand in accordance with an embodiment of the present application.

Figure 1:
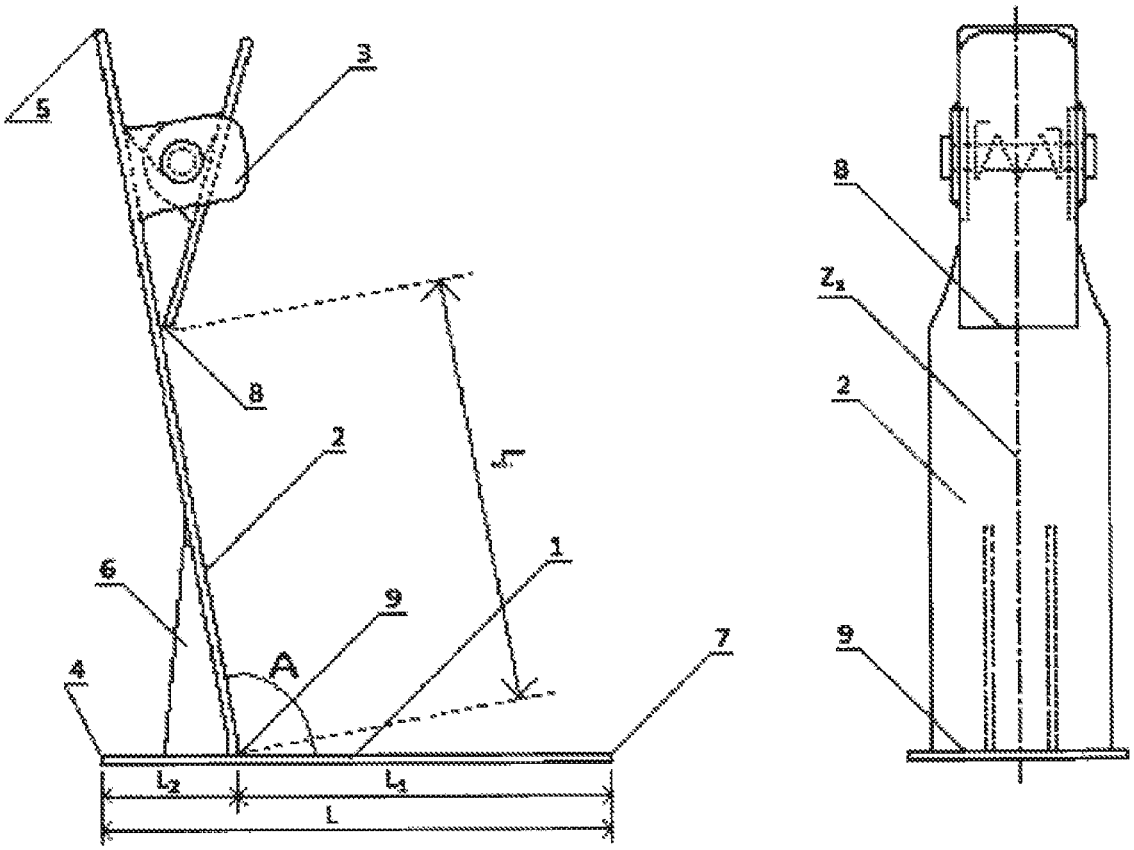
FIG. 1 is a schematic diagram illustrating a basic structure according to an example of the present disclosure, where the right diagram is the right view of the left diagram.
Figure 6:
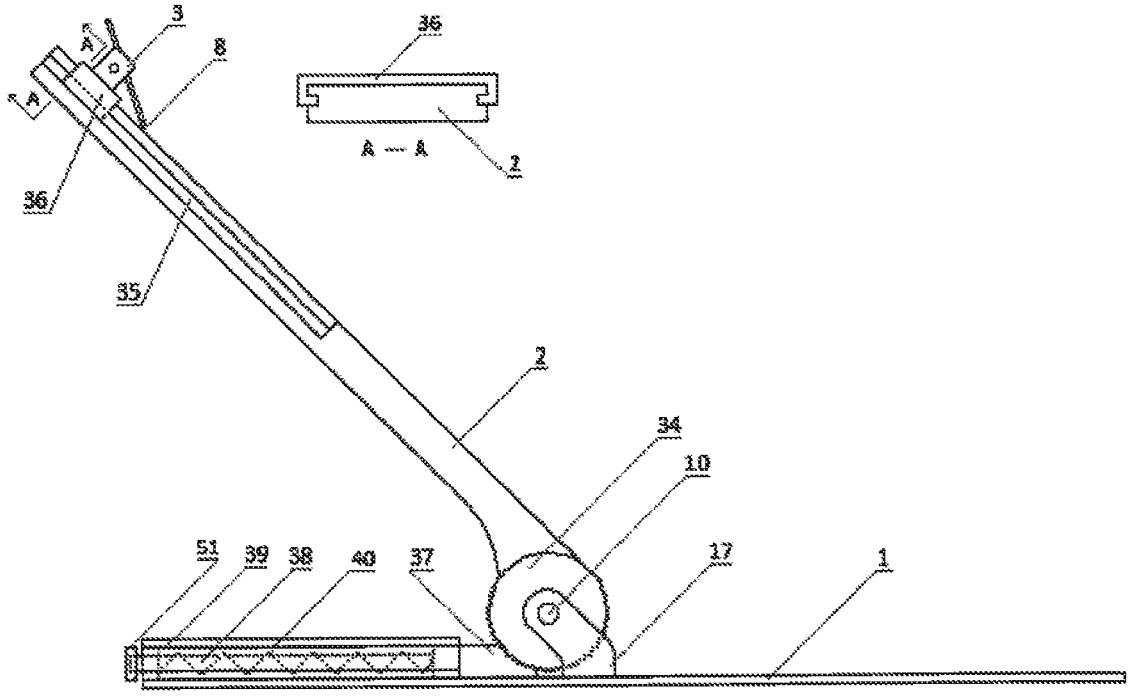
FIG. 6 is a schematic diagram illustrating a structure of an example of a foldable portable reading book stand with a wedge braking ratchet mechanism and an adjustable reading angle A.
Figure 8:
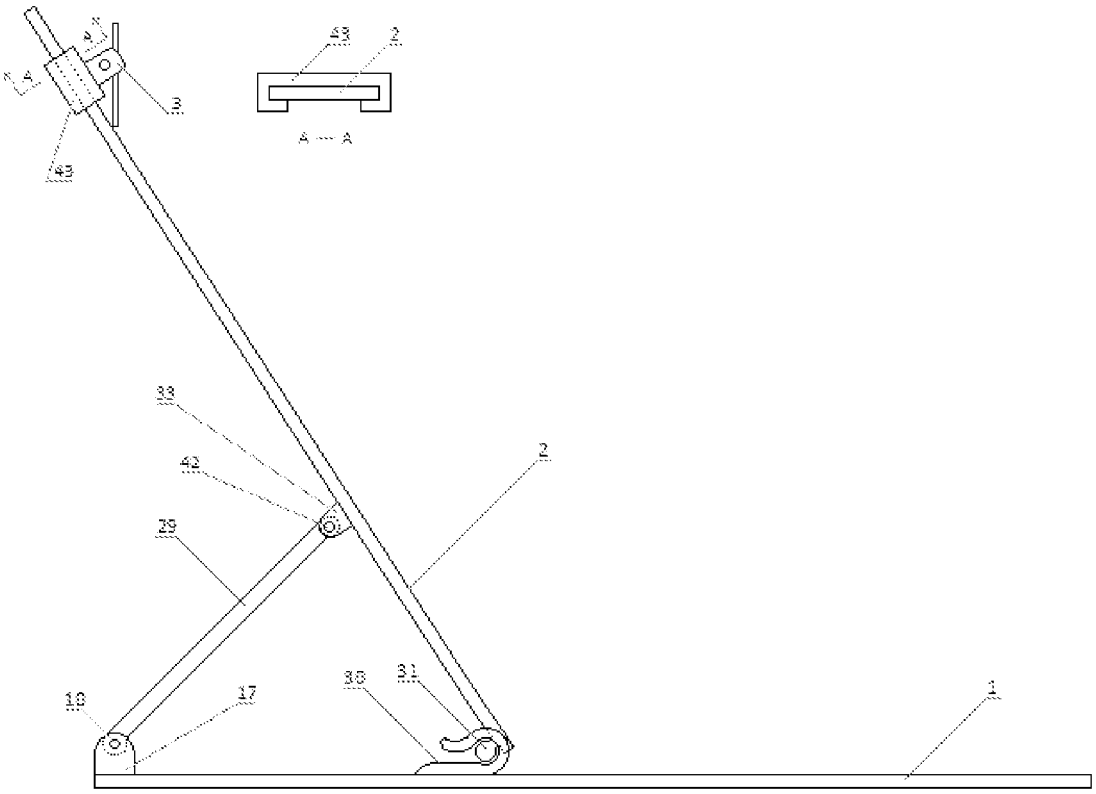
FIG. 8 is a schematic diagram illustrating a structure of an example of a foldable portable reading book stand with a connecting rod hinge mechanism.

In the drawings, 1 refers to a base plate, 2 refers to a support plate, 3 refers to an elastic clamp in a broad sense, 4 refers to an end, 5 refers to an end, 6 refers to a reinforcing rib plate, 7 refers to an end, 8 refers to a clamping edge, 9 refers to a theoretical interesting line, 10 refers to a shaft, 11 refers to a connecting plate, 12 refers to a magnet, 13 refers to a braking base, 14 refers to an elastic support, 15 refers to a sliding channel, 16 refers to a sliding block, 17 refers to a shaft base, 18 refers to a box cover, 19 refers to a spring bolt, 20 refers to a spring bolt baffle, 21 refers to a sliding support plate, 22 refers to a supplementary plate, 23 refers to tooth-shaped sliding channel, 24 refers to a spring, 25 refers to a sliding base in a broad sense, 26 refers to a braking elastic sheet 26, 27 refers to a sliding block baffle, 28 refers to a general spring clamp, 29 refers to a shaft connecting rod, 30 refers to an elastic snap eye of a braking snap, 31 refers to a lever snap, 32 refers to a spring in FIGS. 8.1 and 8.2, 33 refers to a shaft base on a support plate in FIGS. 8.1 and 8.2, 34 refers to a ratchet, 35 refers to a sliding channel (groove) in FIG. 6, 36 refers to a sliding base of a clamp 3 matched with the sliding channel (groove) 35, 37 refers to a spring-driven braking wedge matched with the ratchet 34, 38 refers to a pull rod connected with the braking wedge 37, 39 refers to a casing base for fixing the spring-driven braking wedge mechanism, 40 refers to a spring in FIGS. 6 and 8.2, 41 refers to a spring in FIGS. 8.1 and 8.2, 42 refers to a shaft on a support plate in FIGS. 8.1 and 8.2, 43 refers to a rectangular sliding base, 44 refers to an anchor of the support plate 2, 45 refers to a sliding base of a circular sliding channel, 46 refers to a round support rod, 47 refers to a bolt, 48 refers to a dovetail groove plugging base, 49 refers to a recessed or through sliding channel (groove), 50 refers to a cam, 51 refers to a pull handle, 52 refers to a sliding base with a carrying plate, A refers to a reading angle, L refers to a length of the base plate 1, $L_1$ refers to a distance between the intersecting line 9 and the end 7 theoretically, $L_2$ refers to a distance between the intersecting line 9 and the end 4 theoretically, $L_j$ refers to a clamping distance, and $Z_x$ refers to a center line of a surface of the support plate 2 and the base plate 1. 53, 54, and 55 on FIGS. 10 and 10-1 respectively refer to a book, back spine of book, and a fore edge of a book.

DETAILED DESCRIPTION OF THE EMBODIMENTS

The structural relationships of the main components of the reading book stand of the present disclosure will be described below $L_z$ refers to a length of a support plate. A minimum distance between a clamping mouth (edge) of a clamp and an intersecting line of the base plate when the clamping mouth (edge) clamps ½ width of a margin of a fore edge of a book well placed at initial reading is a clamping distance denoted as $L_j$. Theoretically, Lj should be equal to a minimum distance between a tangent plane across the clamping mouth (edge) and the support plate and the intersecting line of the base plate, and the clamping mouth (edge) should be parallel to the intersecting line. $L_h$ refers to a length of a sliding base fixed with a clamp along a sliding direction of the support plate at a side of the clamp. S refers to a sliding stroke of the sliding base. δ refers to a maximum thickness of a book set for the reading book stand. $L_s$ refers to a length of a read book along a vertical direction of text. $L_{smax}$ and $L_{smin}$ respectively refers to a maximum length and a minimum length of a read book at a maximum folio size and a minimum folio size along the vertical direction of text. $L_z$ refers to a length of a support plate 2. Thus, it should be assumed that $L_z=L_h+L_{smax}+\delta+$ or $L_z=L_h+L_{smin}+S+\delta$, where $S=L_{smax}-L_{smin}$. Generally, the length of $L_1$ should be no less than ½ of a length of the read book along the vertical direction of text. It should be assumed that $L_1\geq\frac{1}{2}L_{smax}$ and $L_1$ should be no greater than $L_{smin}$ at the same time. When the impacts of the clamp, its sliding base, gravity of the support plate portion contained herein and the thickness of the book are neglected, the length of $L_1$ theoretically should be no less than $\frac{1}{2}L_s$, and a range of a ratio of $L_s$ and $L_1$ is recommended to be 2:1-1:1. $A_{max}$ refers to a maximum angle set for the reading book stand. A given safety coefficient should be considered based on the book $L_{smax}$ of the maximum folio size and the maximum book thickness δ and the maximum reading angle $A_{max}$ adopted for the reading book stand. The $L_2$ of the actual product should be greater than the theoretical $L_2$. Generally, there should be $L_2\geq[\frac{1}{2}*(L_h+L_s)*\sin(A-90°)]$. Considering a good stability of the reading book stand, diversified use requirements of products and product diversification, there should be a correction value for theoretical calculation of the L2, which is denoted as Δ and then $L_2=[\frac{1}{2}*(L_h+L_s)*\sin(A-90°)+\Delta]$. Considering that the exterior sizes of the reading book stand should be minimized on the condition of satisfying the use requirements, the L2 usually shall not be greater than a vertical projection of Lz on a plane where a bottom surface of the base plate [1], that is, L2 shall not be greater than $[L_z*\sin*A-90°)]$. Thus, a value range of the Δ should be: $[L_z*\sin(A-90°)]\geq\Delta\geq[\frac{1}{2}*(L_h+L_s)*\sin(A-90°)]$. $L_s\geq L_1\geq\frac{1}{2}L_s$ is a reasonable length range and $L_s\geq L_1=\frac{1}{2}L_s$ is a reasonable value selection method.

It is noted that $L_1\geq\frac{1}{2}L_s$ is assumed because a center of gravity of a book usually is a geometrical center of the book. However, in a practical application, it is also allowed that $L_1<\frac{1}{2}L_s$ because it is not a hard index relating to a success of the product. But, based on theoretical considerations, it is more reasonable to adopt $L_1>\frac{1}{2}L_s$. Similarly, the requirement of $L_1\leq L_s$ is also not one hard index but a consideration for presenting a beautiful look and reducing occupation space. It is noted that the case of $L_1>L_s$ is also allowed in a practical application. Furthermore, the case of $L_2>L_z*\sin(A-90°)$ is also allowed.

The adjustment and the structural relationship of the reading angle A and the clamping distance $L_j$ of the reading book stand of the present disclosure are described below in four cases.

a. The reading angle A is not adjustable and the clamping distance $L_j$ is not adjustable. As shown in FIG. 1, in this case, S=0 and the impact of δ is neglected, then there will be that $L_z=L_h+L_s$. It can be assumed that $L_2>[\frac{1}{2}*(L_h+L_s)*\sin(A-90°)]$ or $L_2=[\frac{1}{2}*(L_h+L_s)*\sin(A_{max}-90°)+\Delta]$. In a case of $[L_z*\sin(A-90°)]\geq\Delta\geq[\frac{1}{2}*L_z*\sin(A-90°)]$, a ratio range of the Ls and L1 is recommended to be 2:1-1:1. Thus, $L_1\geq\frac{1}{2}L_s$ can be assumed.

b. The reading angle A is not adjustable and the clamping distance is adjustable. As shown in FIGS. 3, 4, 5, 6, 7 and 9, it can be assumed that $L_2>[\frac{1}{2}*(L_h+L_{smax})*\sin(A-90°)]$ or $L_2=[\frac{1}{2}*(L_h+L_{smax})*\sin(A-90°)+\Delta]$. In a case of $[L_z*\sin(A-90°)]\geq\Delta\geq[\frac{1}{2}*(L_h+L_{smax})*\sin(A-90°)]$ the ratio range of $L_s$ and $L_1$ is recommended to be 2:1-1:1, and it can be assumed that $L_1\geq\frac{1}{2}L_{smax}$. Generally, $L_{smin}\geq L_1\geq\frac{1}{2}L_{smax}$ is a reasonable length range and $L_{smin}\geq L_1=\frac{1}{2}L_{smax}$ is a reasonable value selection method.

c: The reading angle A is adjustable and also is of single axis adjustment. As shown in FIG. 6, it can be assumed that $L_2>[\frac{1}{2}*(L_h+L_{smax})*\sin(A_{max}-90°)]$ or $L_2=[\frac{1}{2}*(L_h+L_{smax})*\sin(A_{max}-90°)+\Delta]$. In a case of $[L_z*\sin(A_{max}-90°)]\geq\Delta\geq[\frac{1}{2}*(L_h+L_{smax})*\sin(A_{max}-90°)]$, the ratio range of the $L_s$ and $L_1$ is recommended to be 2:1-1:1 and it can be assumed that $L_1\geq\frac{1}{2}L_{smax}$. Generally, $L_{smin}\geq L_1\geq\frac{1}{2}L_{smax}$ is a reasonable length range and $L_{smin}\geq L_1=\frac{1}{2}L_{smax}$ is a reasonable value selection method.

d: The reading angle A is adjustable, and also is of double axis adjustment. As shown in FIG. 8.2, the $L_1$ and the $L_2$ change along with the change of the reading angle A. It is assumed that a distance from the shaft 10 to the end 7 of the base plate 1 is L' and the maximum reading angle is $A_{max}$, and corresponding $L_1$ and $L_2$ are initial values. When the A is adjusted gradually to become small, the $L_2$ and $L_1$ are increased accordingly. When the reading angle reaches an extreme angle A=90°, $L_2$=0, and $L_1$=L'. When the shaft 10 is provided at the end 4 of the base plate 1, as shown in FIG. 8.2, L'=L. At this time, $L_1$=L'=L. Assuming $A_{max}$ is an initial state, it can be correspondingly assumed that $L_2>[½*(L_h+L_{smax})*\sin(A_{max}-90°)]$ or $L_2=[½*(L_h+L_{smax})*\sin(A_{max}-90°)+\Delta]$. Then, there will be that $[L_z*\sin(A_{max}-90°)]\geq\Delta\geq[½*(L_{h+}L_{smax})*\sin(A_{max}-90°)]$. Assuming $L_1=½L_{smax}$ at the initial state of $A_{max}$, then the range of the $L_1$ is $½L_{smax}\leq L_1\leq L$.

The present disclosure will be further described through examples in combination with accompanying drawings.

FIG. 1 illustrates a reading book stand with simple structure which is a basic type of the present disclosure. The reading book stand includes a base plate 1, a support plate 2 and a spring clamp 3. The support plate 2 serves as a clamping plate of the spring clamp. The support plate 2 and the base plate 1 are fixed together. A reading angle A and a clamping distance Lj are not adjustable and a proper angle range is between 100-135 degrees. The reading book stand may be customized according to requirements and is applicable to reading a thin book with a single specification. It is determined whether a rib plate 6 is used according to a strength of material. Also, another type of alternative rib plate 6 may be used, for example, the support plate itself is made into a groove shape or a vertical wave shape or a hollow material is used to increase the rigidity of the support plate itself. If a metal sheet is used, it may be bent at a combination end with a bending angle supplementary to the reading angle A and a bending part is combined with the base plate 1. The spring clamp 3 is fixed near an end 5 of the support plate 2. It should be ensured that the entire center of gravity of the reading book stand including book will fall on the base plate 1 and is preferably 5-10 mm from an end 4 during a use process. On the precondition of ensuring the strength and the rigidity of the reading book stand, the support plate 2 and the base plate 1 may be narrowed to 10 mm-20 mm so that the reading book stand still can stand stably with a book removed. Further, the base plate 1 may be properly wider than the support plate 2. An intersecting line 9 divides a length L of the base plate 1 into two parts, $L_1$ and $L_2$, and $L=L_1+L_2$. The $L_2$ acts to prevent the entire center of gravity of the book and the reading book stand from falling outside the end 5 of the base plate 1 during a normal use of the reading book stand, that is, $L_2$ needs to ensure the entire center of gravity of the book and the reading book stand during the normal use of the reading book stand always falls on the base plate 1, thereby preventing a torsional topple of the reading book stand toward the end 4. Thus, $L_2$ should have a sufficient length but shall not be excessively long on the condition of ensuring the use requirements are satisfied. The $L_1$ may be pressed by the book to increase the stability of the reading book stand and prevent the torsional topple of the reading book stand toward the reader resulting from a pull imposed by the book through the clamp near the end 5 of the support plate 2 during a normal use of the reading book stand. To further reduce the weight of the reading book stand and save materials, the base plate 1 and the support plate 2 may be formed by bending a steel wire of satisfactory strength-toughness match into a closed rectangular frame and welding the breaking points and the reading book stand may also be formed by performing one-time bending for one steel wire and welding the breaking points. It is recommended to use a stainless steel sheet of a thickness of 1 mm and the recommended sizes are: the width of the base plate 1 is 0 mm and the width of the support plate 2 is 17 mm.

It is usually recommended not to fix the clamp 3 on the end 5 of the support plate shown in FIG. 1 but to combine the clamp 3 and the support plate 2 in a sliding manner to facilitate adjusting the size of the clamping distance $L_j$.

Figure 2:
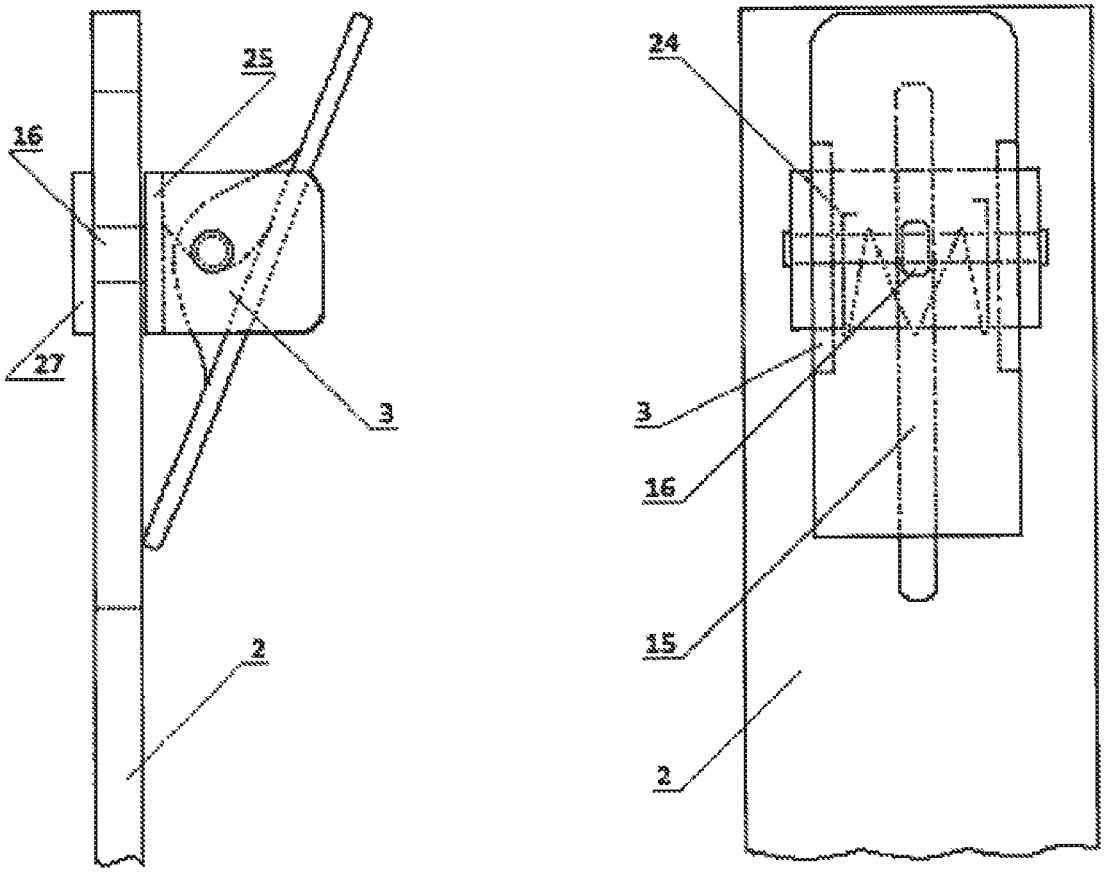
FIG. 2 is a schematic diagram illustrating a structure of an example of a sliding mechanism formed by a support plate 2 and a clamp 3, where the right diagram is the right view of the left diagram.

FIG. 2 is a schematic diagram illustrating a structure of an example of a sliding mechanism formed by the support plate 2 and the clamp 3. The support plate 2 is provided with a sliding channel 15. The spring clamp 3 is fixed on a sliding base 25 connected with a sliding block 16 and a baffle 27 and a sliding block 16 slides in the sliding channel 15. The support plate 2 serves one clamping plate of the spring clamp 3. The clamping distance Lj may be adjusted in length through the sliding channel to adapt to books of different folio sizes. In a folding state of the portable reading book stand, the spring clamp 3 may be used to clamp the base plate 1 to bind the reading book stand in a case of disuse or carrying.

Figure 3:
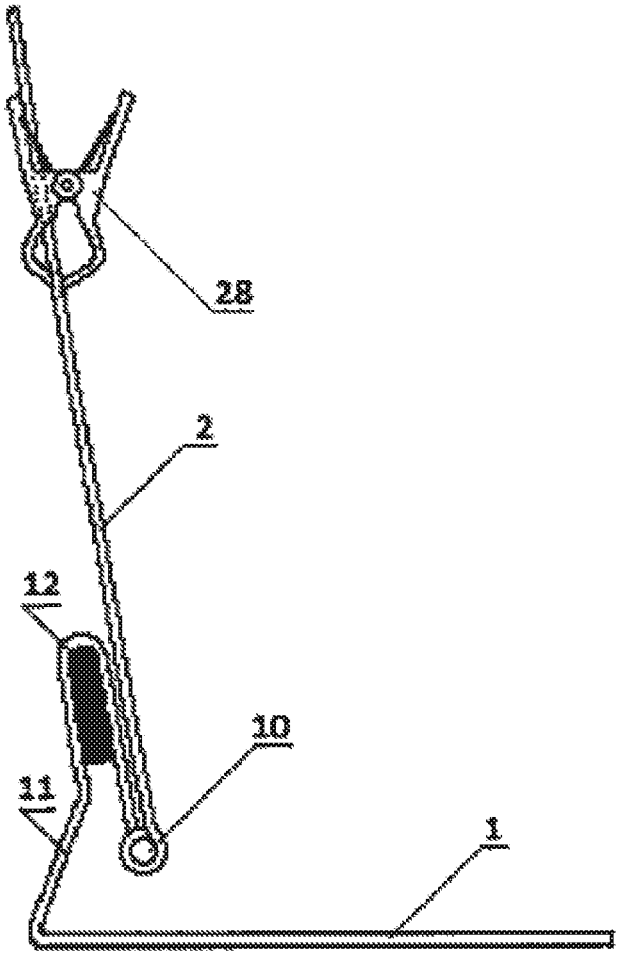
FIG. 3 is a schematic diagram illustrating a structure of an example of a portable reading book stand using a magnetic snap braking mechanism in the present disclosure.

FIG. 3 illustrates a foldable portable reading book stand using a magnetic snap for braking. The support plate 2 is rotated to be folded or opened through a shaft 10. The support plate 2 may adopt a ferromagnetic material so that the support plate is attracted by a magnet 12, thereby playing a braking function for the support plate 2. The combination of the clamp and the support plate 2 may be realized through a separate slide of the support plate 2 and the spring clamp and the spring clamp may be an ordinary spring clamp 28 that is available form market and is of a proper model matched with the width of the support plate. In use, the clamp 28 is assembled on the support plate 2 which passes through a middle of the two clamping plates of the clamp 28 through a spring shaft. The support plate 2 serves as a sliding channel of the clamp 28 and the clamping distance $L_j$ may be adjusted. In disuse, the clamp may be disassembled by pull. The two clamping plates of the clamp 28 may be equal in length or may be non-equal in length. When a clamp with two clamping plates being non-equal in length is to be used, special customization is required so that a long clamping plate is placed at the back cover or front cover of the book and a short clamping plate is placed at a read page of the book. It is recommended to use a metal sheet of a thickness of 1 mm. Also, it is recommended that the width of the base plate 1 is 20 mm and the width of the support plate 2 is 17 mm.

Figure 4:
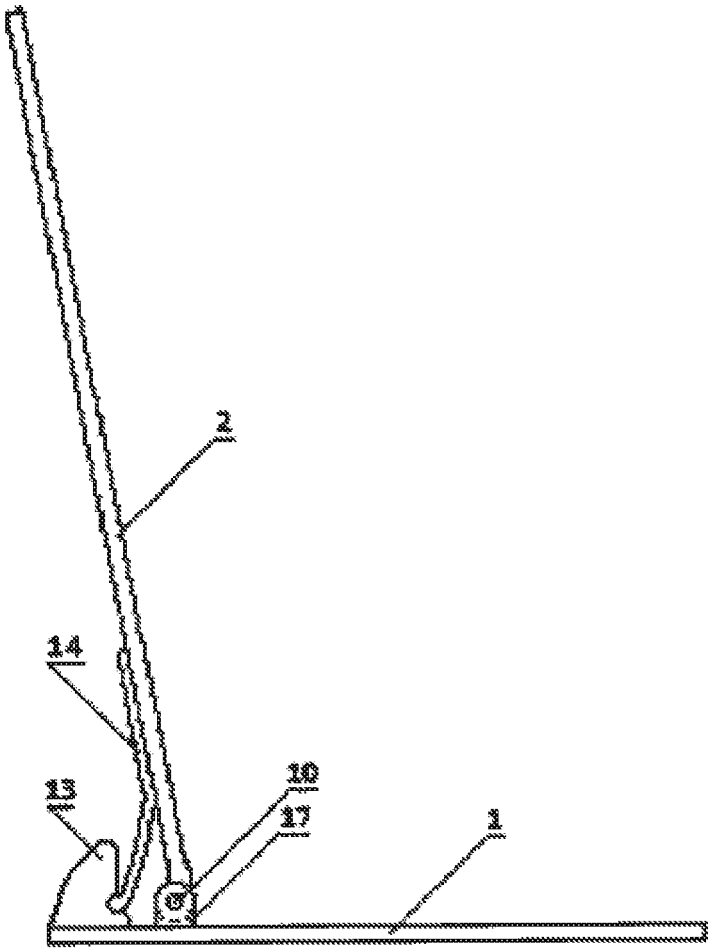
FIG. 4 is a schematic diagram illustrating a structure of an example of portable reading book stand using an elastic snap braking mechanism in the present disclosure.

FIG. 4 is a portable reading book stand using an elastic snap for braking. A braking base 13 and a shaft base 17 are fixed on the base plate 1 and the support plate 2 is rotated to be folded and opened through the shaft 10. An elastic support 14 is fixed on the support plate 2 with an elastic material. In a case of no external force, a rotation radius of the outermost edge of an end of the elastic support 14 with the shaft 10 as a center should be greater than a maximum radius of an inner wall of an arc at a lock snap of the braking base from the shaft 10 to ensure the end of the elastic support 14 and an uneven engaging position of the braking base have sufficient elastic deflection, thereby realizing braking function for the support plate 2. A sliding trajectory of the end of the elastic support 14 on the braking base 13 should be a plane or a straight line and forms an included angle no greater than 90 degrees with the base plate 1 in the direction of the end 4 and preferably forms an angle of 90 degrees. The elastic support 14 may be allowed to obtain a larger deflection by reducing a distance of the braking base 13 and the shaft 10 or reducing an angle of the contact surface (line)

and the base plate 1 in the direction of the end 4 properly at the same time. This contact surface may be a curved surface or a curve. It should be ensured that the elastic deflection of the elastic support 14 reaches a maximum value when the end of the elastic sheet 14 slides to a critical point before an elastic snap. The uneven engaging position of the elastic snap should be located at a maximum projection length of the rotation radius of the end of the elastic support 14 with the shaft 10 as a center of circle at the base plate 1. It should be ensured that the elastic support 14 can smoothly slide into the braking base 13 under the action of external force. The included angle of the elastic support 14 and the support plate 2 (in the direction of the end 5) should be greater than the angle A. With the base plate 1 as a reference, a height of the contact surface of the braking base 13 and the elastic support 14 is greater than a height of an initial contact point of both.

Figure 5:
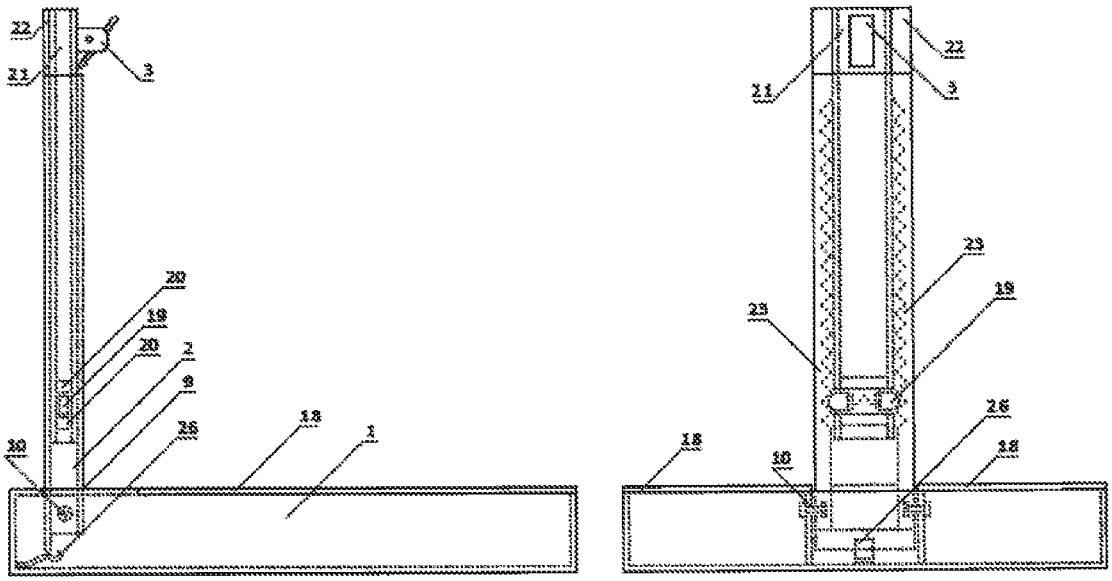
FIG. 5 is a schematic diagram illustrating a structure of an example of a multi-functional reading book stand with a support plate telescopically adjustable in length in the present disclosure, where the right diagram is the right view of the left diagram.

FIG. 5 is a multi-functional reading book stand. The support plate 2 is assembled onto a box through the shaft 10 (the base plate 1 of the reading book stand is the box). The support plate 2 is a hollow rectangular component, on both sides of which are arranged sawtooth-shaped sliding channels. A movable support plate 21 is also a hollow rectangular component with an elastic bolt baffle 20 assembled on its lower part and a spring bolt is arranged in the elastic bolt baffle 20. The moveable support plate 21 is inserted into the support plate 2. and a supplementary plate 22 acts to control the retracting length of the support plate to be flush with an external surface. When a book is read, the support plate 2 is opened and a lower edge of the support plate 2 is in contact with an elastic sheet 26 so that the spring sheet is pressed to generate the elastic deflection and the support plate 2 continues sliding to a hook position of the elastic sheet 26, thereby locking the reading angle. The distance of the box cover 18 and the intersecting line 9 should not be less than a set thickness of book. The external size of the box should be matched with the folio size of the used book. In case of a smaller external size of the box, the support plate may be of telescoping type (as shown in FIG. 5). In a case of a larger external size of the box, the support plate may be of a type shown in FIG. 2.

FIG. 6 is a schematic diagram illustrating a structure of an example of a foldable portable reading book stand with a wedge braking ratchet mechanism and an adjustable reading angle A. A casing base 39 and a shaft base 17 are fixed on proper positions of the base plate 1 or integrally fabricated. The support plate 2 and a ratchet 34 are fixed together or integrally fabricated and assembled onto the shaft 10 and a rotating range may be such that a front surface and a back surface of the support plate 1 are respectively in contact with the base plate 1 and the casing base 39. The contact surfaces of the braking wedge 37 and the ratchet 34 are consistent, and a pull rod 38 and the braking wedge 37 are connected or fabricated integrally, the spring 40 is sleeved on the pull rod 38 and the spring is compressed tightly to have a full spring force and then assembled into the matching casing base 39. The ratchet 34 is always subjected to a push force of the braking wedge 37, thereby restricting the support plate 2 from rotating in a direction of the end 4 of the base plate 1. A degree of restriction of the rotation of the support plate 2 in the direction of the end 7 of the base plate 1 depends on the size of an elastic force of the spring 40. According to the actual use situations, springs of different elastic forces may be selected to meet different use requirements. When a position of the support plate 2 is adjusted, a force is applied to the pull rod 38 so that a gap is formed between the braking wedge 37 and the ratchet 34. When the support plate 2 is adjusted to a desired position, the force is removed. The support plate 2 may be made of a thick nonmetal material such as plastic or adopt a dovetail-groove sliding channel.

Figure 7:
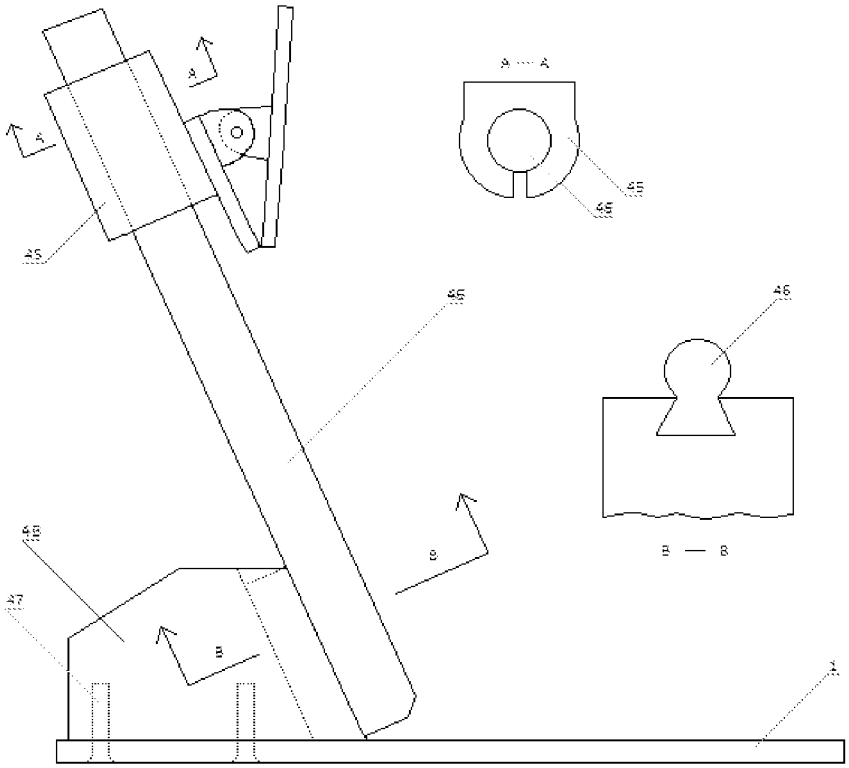
FIG. 7 is a schematic diagram illustrating a structure of an example of a portable reading book stand with a plug connection structure.

FIG. 7 is a schematic diagram illustrating a structure of an example of a portable reading book stand with a plug connection structure. A dovetail groove plugging base 48 is arranged on the $L_2$ of the base plate 1, a guideway matched with the dovetail groove is arranged at a lower end of a round support rod 46, the round support rod may be solid or hollow, an upper end of the round support rod is a circular sliding channel of a circular sliding base 45, the clamp 3 is fixed at the circular sliding base 45, a length of a lower clamping plate of the clamp shall not be less than a length of an upper clamping plate. according to the use requirements, the lower clamping plate may be longer than the upper clamping plate but shall not be longer than ½ of a length of the book spine of the read book. The base plate 1 is as thin as about 1 mm-2 mm and is recommended to be made of metal material (or a nonmetal material with strength-toughness performance satisfying the use requirements). The dovetail groove plugging base is fixed by a bolt 47 on the base plate 1 or fixed by welding or bonding technology. The dovetail groove plugging base is recommended to be made of a nonmetal material such as plastic. The circular sliding channel and the dovetail groove sliding channel should be closely mated with corresponding inserts to ensure there will be sufficient wrapping force between the dovetail channel of the plugging base 48 and the sliding base 45. The adjustment of the clamping distance $L_j$ may also be achieved by fixing the clamp 3 on the end 5 while the round rod is made into a sleeve pull telescoping type. The sleeve pull telescoping positioning method is a mature prior art, such as a pull rod of a suitcase and a support rod of an electric fan.

FIG. 8 is a schematic diagram illustrating a structure of an example of a foldable portable reading book stand with a connecting rod hinge mechanism, where the foldable portable reading book stand is in an opened state in use. A hinge connection is formed between the shaft connecting rod 29 and both of the base plate 1 and the support plate 2. A lever snap 31 is fixed at the lower end of the support plate 2, the elastic snap eye 30 of the braking snap is fixed on the theoretical intersecting line 9 of the base plate 1 according to the set reading angle A, the lever snap 31 may enter or leave the elastic snap eye 30 by manual operation, thereby unlocking and locking the snap. In normal use, a locking state is maintained, and in disuse, unlocking may be performed to fold up the reading book stand through the hinge mechanism. In a folding state, the distance of the shaft 10 and the base plate 1 and the distance of the shaft 42 and the support plate 2 may be neglected. The lower end of the support plate may be approximately aligned with the end 4 of the base plate and at the same time, the end 5 of the support plate 2 and the end 7 of the base plate 1 may also be aligned or approximately aligned. The clamp 3 is fixed on the non-closed sleeve type sliding base 43. The distance of the lever snap 31 and the shaft 42 is set to $L_3$, the distance of the shaft 42 and the shaft 10 is set to $L_4$, and the $L_3$ should not be greater than $L_4$.

To ensure the reading book stand shown in FIG. 8 is tensioned during use, a spring may be installed at the hinge to allow the reading book stand to be always in a tensioned stress state during use.

The support plate 2 of the apparatus shown in FIG. 8 adopts a hollow or solid round rod, that is, the support plate 2 is replaced with the round rod. In this case, the contact surface of the round rod and the base plate 2 should be a straight line, and the straight line should be paralleled to and overlapped with a centerline of a surface along the length direction of the base plate. When the clamp 3 fixed on the sliding base is combined with the round rod, the round rod is a sliding channel. It is also a feasible solution that the clamp is fixed on the sliding base matched with the round rod. The advantages are that the rigidity of the round rod is stronger than the sheets and the circular sliding channel may easily adopt a circular or slightly elliptical non-closed elastic sheet. The clamp is fixed at the sliding base made of the circular or slightly elliptical non-closed elastic sheet to form a wrapping force, resulting in good clamping effect. When the clamping distance $L_j$ is adjusted, no slip will occur after positioning following movement. A general clamp available from market may be fixed on the above sliding base 43. Since the sliding shaft is circular, the sliding base may also be adjusted rotatably so that the clamping edge 8 is easily maintained paralleled to the theoretical intersecting line 9.

FIG. 8.1 is a top view of a folding state after a spring is added and a clamp is removed based on FIG. 8. The reading book stand may be folded up in case of disuse. In the folding state, the support plate 2 and the base plate 1 are attached together. Theoretically, two attaching surfaces should be in a parallel and overlapping state and the contact surfaces should also be parallel and overlapped along the center line $Z_x$ of the length direction. The elastic force generated by the spring 41 acts on the shaft connecting rod 29 and the support plate 2 both coaxial with the shaft 42, and also is a force allowing the shaft connecting rod 29 and the support plate 2 to be opened with the shaft 42 as a rotation shaft. An elastic force generated by the spring 32 acts on the shaft connecting rod 29 and the base plate 1 both coaxial with the shaft 10 and also is a force allowing the shaft connecting rod 29 and the base plate 1 to be closed with the shaft 10 as a rotation shaft.

FIG. 8.2 is a schematic diagram illustrating a structure of an example of a foldable portable reading book stand with a connecting rod hinge mechanism and an adjustable reading angle A, which is also a top view of a folding state after a spring mechanism and a wedge braking ratchet mechanism are added, an elastic snap eye 30 of a braking snap is removed, a portion of length of the end 7 of the base plate 1 is properly cut off (equivalent to a length of the sleeve 43 along a sliding direction) and a lever snap 31 is replaced with an anchor 44 made of plate material Its spring mechanism adopts the apparatus shown in FIG. 8.1 equivalently and the braking mechanism adopts the apparatus shown in FIG. 6 equivalently. To allow the support plate 2 and the base plate 1 of the reading book stand to have good stability in contact in an opening state, the anchor 44 may be arranged so that both ends and the base plate 1 are in real contact and a false contact is present in the middle. The width of the anchor 44 shall be no less than the width of the support plate 2 but slightly less than the width of the base plate 1. The reading angle A may be adjusted arbitrarily by displacement of the anchor 44 on the base plate 1, the set reading angle may be adjusted in a range of 100-135 degrees. Correspondingly, a recessed or through sliding groove (channel) matched with the anchor 44 is arranged in the displacement interval of the anchor 44 on the base plate 1. The steps of completing folding from the opening state are as follows: firstly, an expanding elastic force of the spring 41 and a push force imposed by the spring 40 to the ratchet 34 through the braking wedge 37 are overcome, the support plate 2 and the shaft connecting rod 29 are kneaded together, the reading book stand will automatically fold up under the action of the closing force applied by the spring 32, and at this time, the clamp 3 is located near the end 5 of the support plate 2 and may clamp the end 7 of the base plate 1; the steps of completing opening from the folding state are as follows: the clamp 3 is pulled away from the end 7 of the base plate 1, a pull force is applied to the pull rod 38 to open the self-locking of the braking wedge 37 and the ratchet 34 and leave a gap, the support plate 2 will generate tendency to open under the action of the spring 41 and overcome, through human lift, the closing force applied by the spring 32, and the connecting rod 38 is released when a desired reading angle A is reached.

Figure 9:
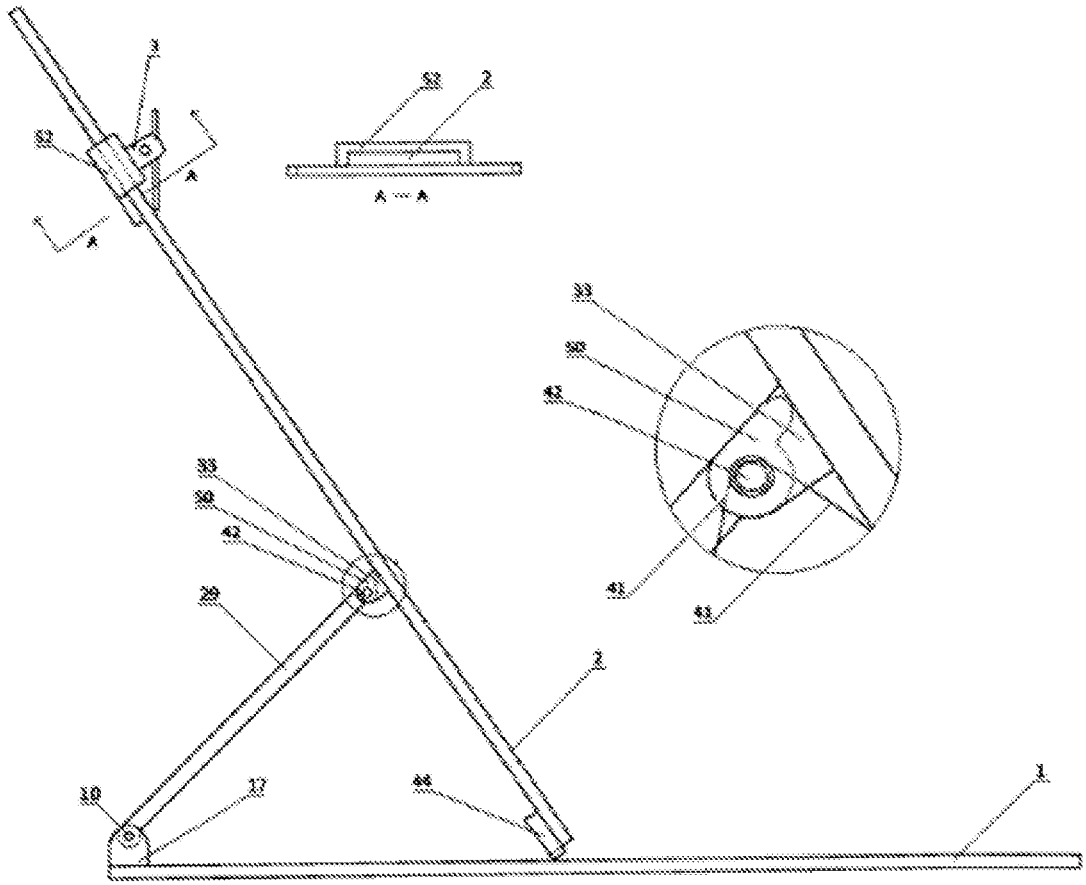
FIG. 9 is a schematic diagram illustrating a structure of an example of a foldable portable reading book stand with a cam braking connecting rod hinge mechanism.

FIG. 9 is a schematic diagram illustrating a structure of an example of a foldable portable reading book stand with a cam braking connecting rod hinge mechanism. FIG. 9.1 is a top view of a folding state of FIG. 9. It is only required to arrange a protrusion that may prevent the support plate 2 reaching the set reading angle by rotation from further rotating at a proper position of the shaft sleeve that is on the shaft 42 and integrally connected with the connecting rod 29. The cam 50 is fixed with or integrally fabricated with an end of the connecting rod 29 together. The shape size and position of the cam is determined by the set reading angle A. The contact of the cam and the support plate 2 may be a point contact or may be a line contact or surface contact. Taking the point contact as an example, a vertical distance from the contact point to the shaft center line of the shaft 42 should be always greater than a vertical distance from the shaft center line to a surface plane of the support plate 2 where the contact point is located. The sliding base fixed with the clamp is provided with a carrying plate wider than a width of the sliding stroke portion of the support plate 2 and the clamping edge 8, whichever is larger. The position shape of the carrying plate is like the lower clamping plate of the clamp without a clamping function, which acts to carry the pages of the book clamped by the upper clamping plate and falling due to smaller width of the lower clamping plate (support plate 2). Some readers like to use a large reading angle A, the read book or practice book is soft paperback book and the ratio of the width of the fore edge of the book clamped by the clamp (equal to the length of book spine) and the width of the lower clamping plate of the clamp (support plate 2) is large. At this time, both ends of the fore edge of the book clamped by the clamp are easy to droop, and the sliding base 52 with the carrying plate may better solve the problem. To minimize the volume of the reading book stand in the folding state (to be precise, exterior size), the length from the center line of the shaft 42 to the end of the anchor 44 is set to $L_3$, and the distance from the center line of the shaft 42 to the centerline of the shaft 10 is set to the length of the connecting rod 29, $L_4$, and then L3 should be equal to L4, $L_z$=L or Lz should be longer than a length of the sliding base 43 along the sliding direction. For example, the reading angle is set to A=120 degrees, $L_3=L_4$, $L_z$=L or $L_z=(L+L_s)$, and then the reading book stand may have a smaller and relatively regular exterior size.

A new type may be formed by splitting and recombining different types between different examples. For example, the ordinary spring clamp 28 shown in FIG. 3 may be used to replace the clamp 3 fixed on the support plate 2 shown in FIG. 1. After replacement, the clamping distance $L_j$ may be adjusted for the reading book stand shown in FIG. 1, and further, the sliding base 43 or the sliding base 52 fixed with the clamp may be sleeved on the support plate 2 in FIG. 1.

The invention claimed is:

1. A reading book stand, comprising a base plate, a support plate or rod and a clamp arranged on an end of the support plate or rod to clamp a fore edge of a book being read, wherein the support plate or rod and the base plate form a reading angle (A) and a theoretical intersecting line, the theoretical intersecting line divides a length (L) of the base plate into a first part ($L_1$) and a second part ($L_2$) with the first part ($L_1$) serving to support the book together with the support plate or rod, and the second part ($L_2$) being the remaining part of the base plate, in a normal use state, the base plate is placed on a desk surface or on another plane, center lines of the support plate or rod and the base plate are configured to be approximately perpendicular to a back spine of the book respectively, and a middle part of the back spine is placed on the intersecting line, the book is opened and divided into two parts, one part where a read page is located is leaned against the support plate or rod and a direction of a text pointing from a lower edge to an upper edge in a vertical direction is set to a vertical forward direction of text, the vertical forward direction of the text of the read page points toward the clamp, and the other part naturally falls on the base plate to form a vertical pressure against the base plate, the reading angle (A) is adjustable, the reading angle (A) is not less than 90 degrees, the support plate or rod and the base plate are fixedly combined or shaft-connected or plug-connected, wherein the first part ($L_1$) has a sufficient length so that when it is pressed by the book, it increases the stability of the reading book stand and prevents the torsional topple of the reading book stand toward the reader resulting from a pull imposed by the book through the clamp near the end of the support plate or rod during the normal use of the reading book stand, wherein the base plate has a width of no greater than about 50 mm, wherein the reading angle (A) is arbitrarily adjustable by displacement of an anchor on the base plate, and correspondingly, a recess or through sliding groove matched with the anchor is arranged in the displacement interval of the anchor on the base plate.

2. The reading book stand of claim 1 wherein the first part ($L_1$) has a thickness of no greater than 3 mm.

3. A reading book stand comprising a base plate, a support plate or rod, and a clamp arranged on an end of the support plate or rod to clamp a fore edge of a book being read, wherein the support plate or rod and the base plate form a reading angle (A) and a theoretical intersecting line, the theoretical intersecting line divides a length (L) of the base plate into a first part ($L_1$) and a second part ($L_2$) with the first part ($L_1$) serving to support the book together with the support plate or rod, and the second part ($L_2$) being the remaining part of the base plate, in a normal use state, the base plate is placed on a desk surface or on another plane, center lines of the support plate or rod and the base plate are configured to be approximately perpendicular to a back spine of the book respectively, and a middle part of the back spine is placed on the intersecting line, the book is opened and divided into two parts, one part where a read page is located is leaned against the support plate or rod and a direction of a text pointing from a lower edge to an upper edge in a vertical direction is set to a vertical forward direction of text, the vertical forward direction of the text of the read page points toward the clamp, and the other part naturally falls on the base plate to form a vertical pressure against the base plate, the reading angle (A) is adjustable, the reading angle (A) is not less than 90 degrees, the support plate or rod and the base plate are fixedly combined or shaft-connected or plug-connected, wherein the first part ($L_1$) has a sufficient length so that when it is pressed by the book, it increases the stability of the reading book stand and prevents the torsional topple of the reading book stand toward the reader resulting from a pull imposed by the book through the clamp near the end of the support plate or rod during the normal use of the reading book stand, wherein the base plate has a width of no greater than about 50 mm, wherein a casing base and a shaft base are fixed on proper positions of the base plate or integrally fabricated, the support plate or rod and a ratchet are fixed together or integrally fabricated and assembled onto the shaft and a rotating range is such that a front surface and a back surface of the support plate or rod are respectively in contact with the base plate and the casing base, the contact surfaces of the braking wedge and the ratchet are consistent, a pull rod and the braking wedge are connected or fabricated integrally; a spring is sleeved on the pull rod and the spring is compressed tightly to have a full spring force and then assembled into the matching casing base; the ratchet is always subjected to a push force of the braking wedge, thereby restricting the support plate or rod from rotating in a direction of an end of the base plate; according to the actual use situations, springs of different elastic forces are selected to meet different use requirements; when a position of the support plate or rod is adjusted, a force is applied to the pull rod so that a gap is formed between the braking wedge and the ratchet; when the support plate or rod is adjusted to a desired position, the force is removed.

4. A reading book stand, comprising a base plate, a support plate or rod, and a clamp arranged on an end of the support plate or rod to clamp a fore edge of a book being read, wherein the support plate or rod and the base plate form a reading angle (A) and a theoretical intersecting line, the theoretical intersecting line divides a length (L) of the base plate into a first part ($L_1$) and a second part ($L_2$) with the first part ($L_1$) serving to support the book together with the support plate or rod, and the second part ($L_2$) being the remaining part of the base plate, in a normal use state, the base plate is placed on a desk surface or on another plane, center lines of the support plate or rod and the base plate are configured to be approximately perpendicular to a back spine of the book respectively, and a middle part of the back spine is placed on the intersecting line, the book is opened and divided into two parts, one part where a read page is located is leaned against the support plate or rod and a direction of a text pointing from a lower edge to an upper edge in a vertical direction is set to a vertical forward direction of text, the vertical forward direction of the text of the read page points toward the clamp, and the other part naturally falls on the base plate to form a vertical pressure against the base plate, the reading angle (A) is adjustable, the reading angle (A) is not less than 90 degrees, the support plate or rod and the base plate are fixedly combined or shaft-connected or plug-connected, wherein the first part ($L_1$) has a sufficient length so that when it is pressed by the book, it increases the stability of the reading book stand and prevents the torsional topple of the reading book stand toward the reader resulting from a pull imposed by the book through the clamp near the end of the support plate or rod during the normal use of the reading book stand, wherein the base plate has a width of no greater than about 50 mm, wherein the support plate or rod is a round support rod, a dovetail groove plugging base is arranged on the second part ($L_2$) of the base plate, a guideway matched with a dovetail groove is arranged at a lower end of the round support rod, the round support rod is solid or hollow, an upper end of the round support rod is a circular sliding channel of a circular sliding base, the clamp is fixed at the circular sliding base; the dovetail groove plugging base is fixed by a bolt on the base plate or fixed by welding or bonding technology; the circular sliding channel and the dovetail groove are closely mated with corresponding inserts to ensure there is sufficient wrapping force between the dovetail channel of the plugging base and the sliding base.

* * * * *